US011453023B2

(12) United States Patent
Murray et al.

(10) Patent No.: US 11,453,023 B2
(45) Date of Patent: Sep. 27, 2022

(54) DEVICE OR METHOD FOR CLEANING SPRAY EQUIPMENT AND A SYSTEM RETROFITTED THEREWITH

(71) Applicant: HOSCO FITTINGS, LLC, Wixom, MI (US)

(72) Inventors: Thomas Murray, Beverly Hills, MI (US); Thomas Dougan, Northville, MI (US)

( * ) Notice: Subject to any disclaimer, the term of this patent is extended or adjusted under 35 U.S.C. 154(b) by 0 days.

(21) Appl. No.: 17/048,251

(22) PCT Filed: Apr. 18, 2019

(86) PCT No.: PCT/US2019/028022
§ 371 (c)(1),
(2) Date: Oct. 16, 2020

(87) PCT Pub. No.: WO2019/204546
PCT Pub. Date: Oct. 24, 2019

(65) Prior Publication Data

US 2021/0107026 A1 Apr. 15, 2021

Related U.S. Application Data

(60) Provisional application No. 62/659,838, filed on Apr. 19, 2018.

(51) Int. Cl.
*B05B 15/555* (2018.01)
*B08B 3/02* (2006.01)
(Continued)

(52) U.S. Cl.
CPC ..... *B05B 15/555* (2018.02); *B08B 3/02* (2013.01); *B08B 5/02* (2013.01); *B08B 9/023* (2013.01); *B08B 9/032* (2013.01)

(58) Field of Classification Search
None
See application file for complete search history.

(56) References Cited

U.S. PATENT DOCUMENTS 4,977,911 A * 12/1990 Vetter ..... B05B 15/555 134/34
5,226,565 A * 7/1993 Hladis ..... B05B 15/55 222/148

(Continued)

FOREIGN PATENT DOCUMENTS

WO WO-2018094498 A1 * 5/2018 ..... B05B 14/412

*Primary Examiner* — Eric W Golightly
*Assistant Examiner* — Arlyn I Rivera-Cordero
(74) *Attorney, Agent, or Firm* — Peter Beardsley

(57) ABSTRACT

A cleaning device for use with an atomizer that applies paint to the surface of a component in a spray booth includes an external and internal surface in which a least a portion of one or more of the surfaces are coated with a conductive coating. This conductive coating comprises one or more fluoropolymers and may be static dissipative. The cleaning device further includes an exit port that has an aperture between about 2.54-7.62 cm located in the shroud of the device opposite the opening that receives the atomizer and near a bottom corner of the shroud. A kit used to retrofit existing paint spraying systems includes a fully assembled cleaning device and optionally, a regulator assembly capable of reducing the pressure of a cleaning fluid to about 80 psi. During installation, the regulator assembly is mounted external to the spray booth.

17 Claims, 9 Drawing Sheets

(51) Int. Cl.

| | |
|---|---|
| ***B08B 5/02*** | (2006.01) |
| ***B08B 9/032*** | (2006.01) |
| ***B08B 9/023*** | (2006.01) |

(56) References Cited

U.S. PATENT DOCUMENTS

| | | | | |
|---|---|---|---|---|
| 6,355,114 | B1 * | 3/2002 | White | B05B 3/027 134/179 |
| 6,550,487 | B1 * | 4/2003 | Duckett | A61L 2/22 134/108 |
| 2008/0011333 | A1 * | 1/2008 | Rodgers | B05B 15/555 134/94.1 |

* cited by examiner

DEVICE OR METHOD FOR CLEANING SPRAY EQUIPMENT AND A SYSTEM RETROFITTED THEREWITH

CROSS REFERENCE TO RELATED APPLICATIONS

This application is a national stage application of International Application No. PCT/US2019/028022, filed Apr. 18, 2019, which claims priority to U.S. Provisional Application No. 62/659,838, filed Apr. 19, 2018, each of which are incorporated herein by reference.

This disclosure relates generally to a cleaning device for an atomizer used with automated or manual spray equipment and a system that incorporates such a cleaning device, as well as a method of cleaning therewith.

The statements in this section merely provide background information related to the present disclosure and may not constitute prior art.

Many companies apply one or more coatings to the surface of their products or various components used to form their products in order to provide aesthetic qualities or functional attributes, such as resistance to environmental exposure or wear. The application of these coatings are often accomplished in a painting operation equipped with one or more automated or manual spray paint lines. Each spray paint line typically requires periodic cleaning of the spray equipment in order to efficiently change the color of the paint and/or reduce the occurrence of defects. Thus, each paint line may be equipped with one or more cleaning devices or systems capable of providing for the external cleaning of the spray equipment (e.g., bell cup, shaping air ring, applicator shroud, gun air cap, etc.), drying of the spray equipment after cleaning, and a means to collect any waste solvent/materials that are generated.

However, production and manpower demands during manufacturing often inhibit proper operation or maintenance of the cleaning devices. New coating formulations introduced into a production facility can also provide challenges for the proper cleaning of the spray equipment. A cleaning device or system that is poorly set-up and/or maintained may cause as many defects as it prevents. These defects may result from the build-up of paint on the spray equipment, the plugging of drains associated with the removal of waste solvent/materials from the cleaning system, and/or the use of excessive solvent pressure.

BRIEF SUMMARY

The present disclosure generally provides a cleaning device for an atomizer, a paint spraying system that incorporates such a cleaning device, a kit comprising an assembled cleaning device for retrofitting or replacing conventional cleaning devices, and a method of using the cleaning device. The cleaning device comprises an internal and external surface, wherein at least a portion of one or both of these surfaces are coated with a conductive coating. Alternatively, at least 75% of the internal or external surface of the cleaning device is coated with the conductive coating.

According to one aspect of the present disclosure, the conductive coating may comprise one or more fluoropolymers. Alternatively, the one or more fluoropolymers may include polytetrafluoroethylene (PTFE), fluorinated ethylene-propylene (FEP), perfluoroalkoxy polymers (PFA), or a mixture or copolymer thereof. The conductive coating is static dissipative with a surface resistance that is greater than $1\times10^{1}$ ohms/square and less than $1\times10^{12}$ ohms/square.

According to another aspect of the present disclosure, the cleaning device includes an exit port that is located within a shroud in a location that is opposite to the opening that receives the atomizer and near a bottom corner of the shroud. The exit port comprises an aperture having an inner diameter within the range from about 2.54 cm (1 inch) to about 7.62 cm (3 inches).

According to yet another aspect of the present disclosure, a kit is provided that can be used to retrofit an existing paint spraying system or used during the construction of a new paint spraying system. The kit generally comprises an assembled cleaning device. In addition, the kit may, optionally, include a first connection for coupling with a cleaning fluid line, a second connection for coupling with a drain or recirculation line to remove the cleaning fluid after use, and a third connection for coupling with a line that supplies a gas to the gas-drying ring. When desirable, the kit may further comprise a regulator assembly for mounting external to the spray booth that is capable of controlling the pressure of the cleaning fluid delivered to the entrance port of the cleaning device.

According to yet another aspect of the present disclosure, the paint spraying system may comprise the cleaning device along with a regulator assembly as described above and as further defined herein. This regulator assembly is capable of reducing and maintaining the pressure exhibited by the cleaning fluid to about 80 psi and may be mounted external to the spray booth.

Further areas of applicability will become apparent from the description provided herein. It should be understood that the description and specific examples are intended for purposes of illustration only and are not intended to limit the scope of the present disclosure.

BRIEF DESCRIPTION OF DRAWINGS

In order that the disclosure may be well understood, there will now be described various forms thereof, given by way of example, reference being made to the accompanying drawings, in which:

FIG. 6C is a schematic representation of the regulator assembly of FIG. 6B illustrating the direction of flow for the cleaning fluid there through;

Figure 1:
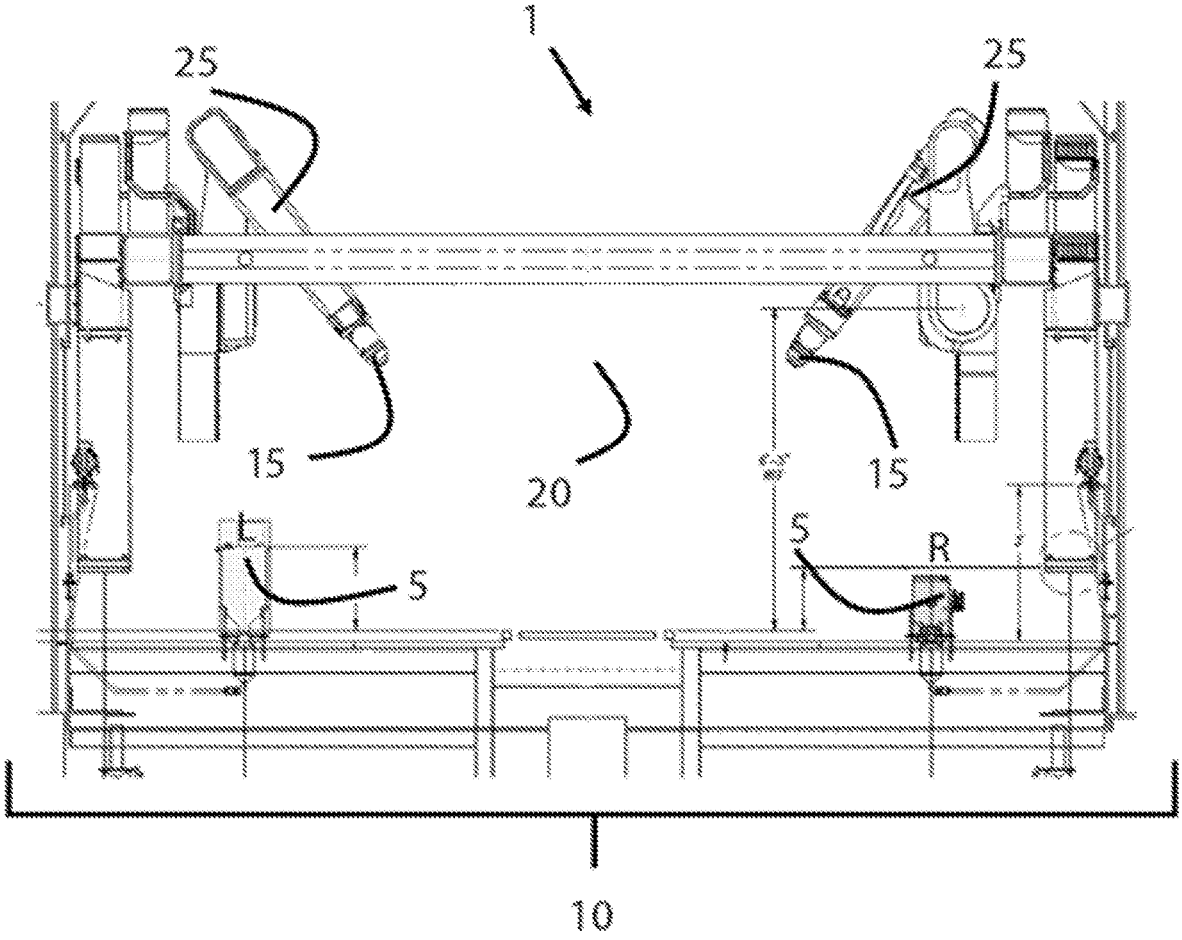
FIG. 1 is a schematic representation of an automated paint spraying system that incorporates a plurality of atomizers and cleaning devices.

The drawings described herein are for illustration purposes only and are not intended to limit the scope of the present disclosure in any way.

DETAILED DESCRIPTION

The following description is merely exemplary in nature and is in no way intended to limit the present disclosure or its application or uses. For example, the cleaning device made and used according to the teachings contained herein is described throughout the present disclosure in conjunction with the robotic application of automotive coatings using a rotary atomizer or paint bell atomizer in order to more fully illustrate the cleaning device and the use thereof. The incorporation and use of such a cleaning device in other applications that involve either the manual or automatic application of a paint or coating to metallic or plastic parts using any form of spray application, including electrostatic spray, rotary atomization, air spray, airless spray, air-assisted airless spray, high volume low pressure (HVLP) spray, or the like are contemplated to be within the scope of the present disclosure. It should be understood that throughout the description, corresponding reference numerals indicate like or corresponding parts and features.

The present disclosure generally provides a cleaning device for an atomizer used in a paint spraying system 1 as shown in FIG. 1. This cleaning device 5 is typically installed within a spray booth 10 and located adjacent to a spray device or atomizer 15, such as a paint bell atomizer, that is used to apply paint to a part or component 20 (e.g., the body of an automobile, etc.). The spray device or atomizer 15 may be an individual spray gun for manual application of the paint or an automatic applicator coupled to a robotic arm 25 for automated application of the paint.

A cleaning device 5 that incorporates the teachings of the present disclosure may be made by more than one manufacturer. In other words, different manufacturers may incorporate the features associated with the cleaning device 5 of the present disclosure during manufacturing of the device or a cleaning device 5 may be retrofitted to include such features taught herein. Thus, the overall geometry of each cleaning device 5 may be the same or different depending upon the preference of each manufacturer, as well as the dimensions associated with the applicator, and the specifications required by the application. Such a difference in geometric shape is depicted in the cleaning devices 5 shown in FIG. 1 installed on the left-side (L) and right-side (R) of the paint spraying system 1. Several examples of manufacturers of cleaning devices include, but are not limited to, Crystal Cap Cleaners Inc. (Ontario, Canada); Circle Dynamics Inc. (Ontario, Canada), Happy Dynamics Ltd. (Ontario, Canada); Fanuc Robotics America Corporation (Michigan, U.S.), Dürr Systems AG (Germany), and ABB Group (Switzerland).

Figure 2:
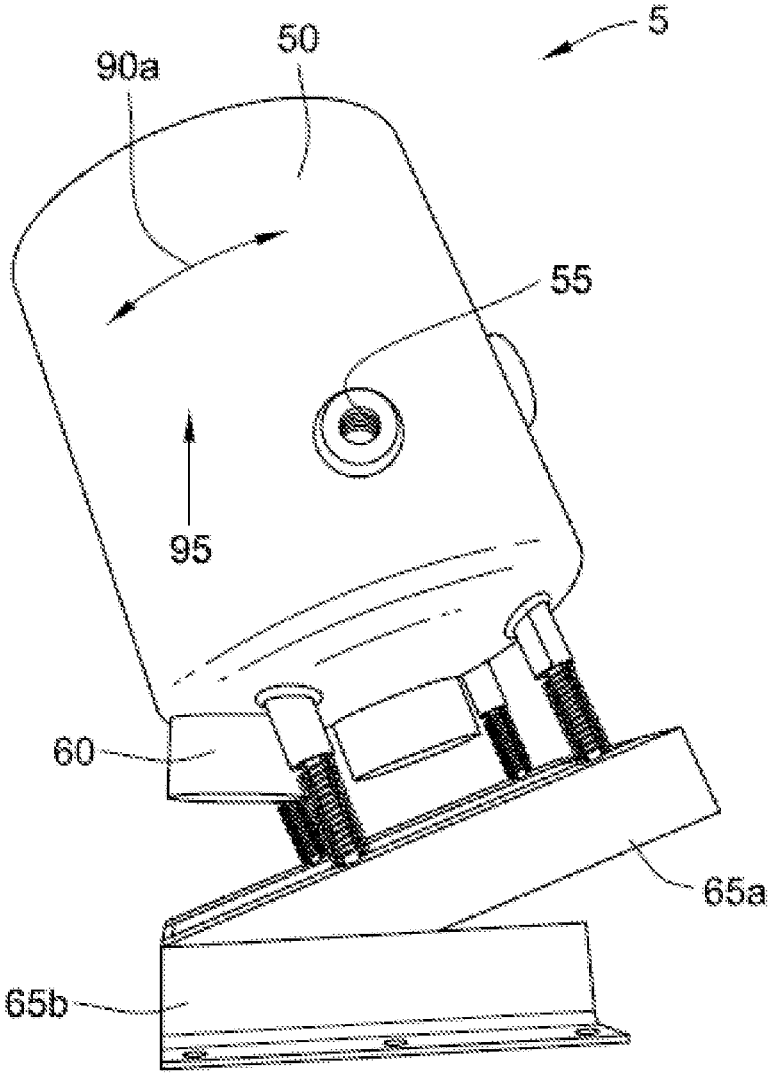
FIG. 2 is a perspective view of a cleaning device constructed according to the teachings of the present disclosure.

Referring now to FIG. 2, the cleaning device 5 generally comprises a shroud 50 that has an entrance port 55 and an exit port 60 that are capable of being opened or closed. The entrance port 55 allows a cleaning fluid to flow there through when the entrance port 55 is opened so that the cleaning fluid may be dispensed through the cleaning nozzles 57 (shown in FIG. 2B). The exit port 60 allows the dispensed cleaning fluid that collects or is contained within the shroud 50 to be removed when it is in the open position. The shroud 50 may be coupled to one or more support brackets 65(*a,b*) with at least one of the support brackets 65*b* being attached to the grating or floor of the paint booth in order to ensure that the cleaning device 5 remains stationary. When desirable, the brackets 65(*a,b*) may be weighted such that the brackets do not need to be attached to the paint booth in order to keep the cleaning device 5 stationary.

For the purpose of this disclosure, the terms "at least one" and "one or more of" an element are used interchangeably and may have the same meaning. These terms, which refer to the inclusion of a single element or a plurality of the elements, may also be represented by the suffix "(s)" at the end of the element. For example, "at least one cleaning nozzle", "one or more cleaning nozzles", and "cleaning nozzle(s)" may be used interchangeably and are intended to have the same meaning.

Figure 3:
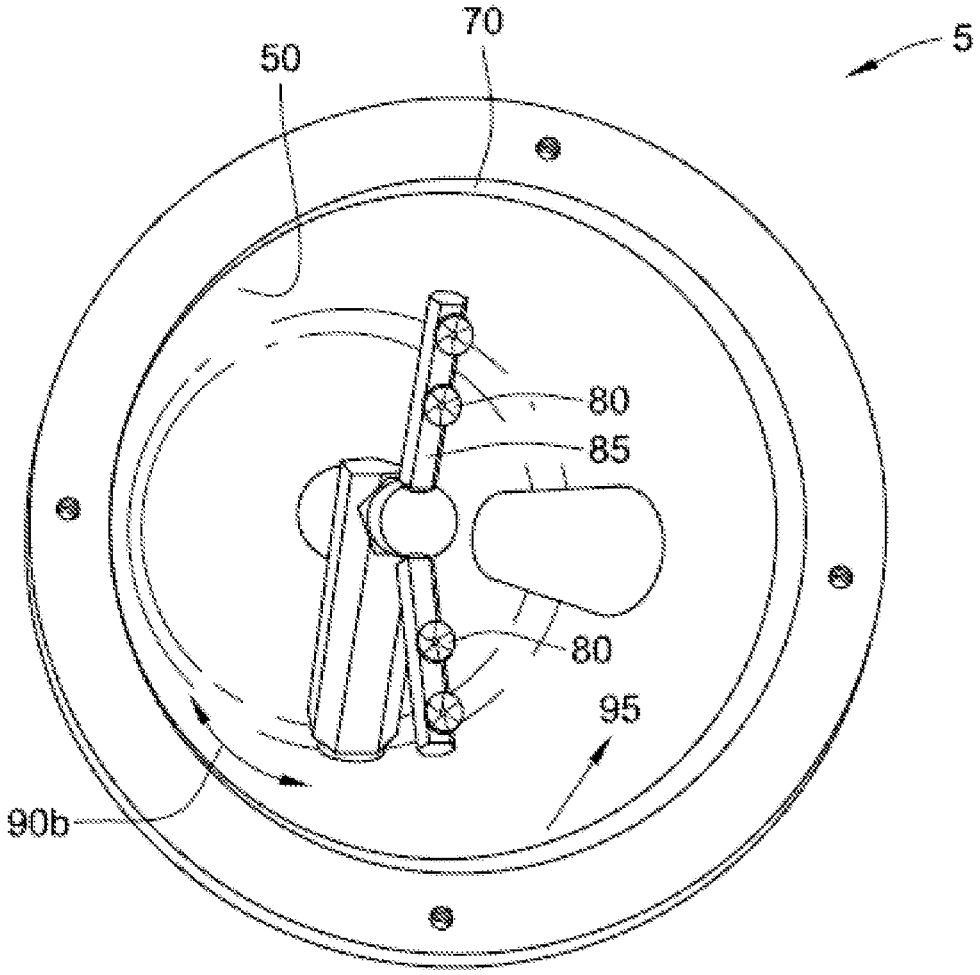
FIG. 3 is a top-down view of the cleaning device of FIG. 2.

Referring now to FIG. 3, the cleaning device 5 further comprises an opening 70 that is capable of receiving an atomizer, wherein upon receiving the atomizer, the opening 70 becomes sealed such that the dispensed cleaning fluid is contained within the shroud 50. Such sealing action may be accomplished by contact between the applicator and the shroud near the opening or in conjunction with a gas-drying ring 75 (best shown in FIG. 5) positioned at the opening. The gas-drying ring 75 is constructed such that air or another gaseous medium is allowed to flow into the shroud 50 in order to evaporate any residual cleaning fluid that remains within the shroud 50 or is present on the surface of the applicator. Thus, the gas-drying ring 75 provides a drying function after the cleaning of the atomizer is complete.

Still referring to FIG. 3, the cleaning device includes a plurality of cleaning nozzles 80 that have an aperture through which the cleaning fluid is dispensed. At least one of the cleaning nozzles 80 is located on a movable member 85 in order to alter the positon of the nozzle during operation and assist in cleaning all parts of the applicator (e.g., bell cup, shaping air ring, applicator shroud, gun air cap, etc.). In the specific example shown in FIG. 3, four cleaning nozzles 80 are located on a member 85 constructed such that it rotates in a circular motion. In this case, the cleaning fluid that is dispensed through the nozzles causes the member 85 to rotate during the cleaning cycle. Thus, in addition to creating a cleaning action for removing paint residue and contamination from the atomizer, the rotating nozzles also wet the shroud's internal surface 90*b*. This wetting of the shroud's internal surface 90*b* ensures that the paint residue or contamination does not adhere to the inner surface 90*b* during the cleaning cycle.

Referring still to both FIGS. 2 and 3, the cleaning device 5 has an external surface 90*a* and an internal surface 90*b*, wherein at least a portion of one or both are coated with a conductive coating 95. The conductive coating generally comprises one or more fluoropolymers. A fluoropolymer is defined to include polymers that are part of a family of thermoplastic materials that contain the element fluorine (F). Fluoropolymers are generally characterized by their properties, which include excellent thermal stability, chemical resistance, and/or low friction.

The fluoropolymers present in the conductive coating 95 may comprise one or more of polyvinylfluoride (PVF), polyvinylidene fluoride (PVDF), polytetrafluoroethylene (PTFE), polychlorotrifluorethylene (PCTFE), perfluoroalkoxy polymer (PFA), fluorinated ethylene-propylene (FEP), polyethylenetetra-fluoroethylene (ETFE), polyethylenechlorotrifluoroethylene (ECTFE), perfluoro-elastomer (FFPM/FFKM), chlorotrifluoroethylenevinylidene fluoride (FPM/FKM), tetrafluoroethyene-propylene (FEPM), or perfluoropolyether (PFPE), to name a few materials. Alternatively, the fluoropolymers may include polyetrafluoroethylene (PTFE), fluorinated ethylyene-propylene (FEP), perfluoroalkoxy polymers (PFA), or a mixture or copolymer thereof. Several specific fluoropolymers that are commercially available include, but are not limited to, Xylan® coatings (Whitford Corporation, Elverson, Pa.), Teflon™ or Tefzel™ coatings (The Chemours Company, Wilmington, Del.), and Kynar® (Arkema Chemicals Co., France).

As used herein, the term "polymer" refers to a molecule having polymerized units of one or more species of monomer. The term "polymer" is understood to include both homopolymers and copolymers. The term "copolymer" refers to a polymer having polymerized units of two or more species of monomers, and is understood to include terpolymers. As used herein, reference to "a" polymer or other chemical compound refers one or more molecules of the polymer or chemical compound, rather than being limited to a single molecule of the polymer or chemical compound. Furthermore, the one or more molecules may or may not be identical, so long as they fall under the category of the chemical compound. Thus, for example, "a" fluoropolymer is interpreted to include one or more polymer molecules of the fluoropolymer, where the polymer molecules may or may not be identical (e.g., different molecular weights, structures, etc.).

The conductive coating 95 is static dissipative in that it has a surface resistance greater than $1\times10^{1}$ ohms/square and less than $1\times10^{12}$ ohms/square. Alternatively, the surface resistivity is less than $1\times10^{10}$ ohms/square; alternatively, between about $1\times10^{3}$ ohms/square and $1\times10^{8}$ ohms/square; alternatively, between about $1\times10^{4}$ ohms/square and $1\times10^{6}$ ohms/square.

The conductive coatings 95 may include one or more additives, such as carbon black, ceramic (inorganic) fillers, or metallic fillers, that lower the electrical resistivity of the coating (e.g., enhances the electrical conductivity). In addition, to increasing the conductivity of the coating, these fillers may also improve the abrasion and wear resistance, as well as other properties exhibited by the conductive coating 95. For example, solid lubricants such as $MoS_2$ (molybdenum disulfide) and graphite when added may improve lubrication, while the addition of metallic powders (e.g., Ni, Al, etc.) may also provide for superior abrasion resistance.

The conductive additives may be incorporated into the conductive coating 95 in the form of a powder (e.g., particles), fibers, or a combination thereof. The conductive additives may be characterized as having a diameter that ranges between 1 nanometer or 10,000 micrometers; alternatively, less than 1,000 micrometers; alternatively, less than 500 micrometers; alternatively, between about 5 nanometers and about 100 micrometers. When desirable, the conductive additives may be carbon black, graphite, ceramic, and/or metallic nanoparticles or carbon nanofibers (CNFs).

The conductive coating 95 may be applied to the external 90*a* and/or internal surface 90*b* of the shroud 50 using any known coating technique, including without limitation, dip coating, spray coating, and flow coating. Alternatively, the conductive coating 95 is applied using a conventional spraying method, such as one in which atomization is driven by air and/or electrostatically with the coating formulation and the surface of the shroud 50 being oppositely charged. The conductive coating 95 may be applied either as a liquid coating formulation or as a powder coating formulation.

Referring once again to FIG. 3, the coating may also be applied to various elements of the cleaning device 5 that are located within the shroud 50, such as the movable member 85, the entrance port, the exit port, etc. At a minimum at least a portion of the external surface 90*a*, internal surface 90*b*, or a combination thereof is coated with the conductive coating 95. Alternatively, at least 75% of the internal surface 90*a* or external surface 90*b* of the shroud 50 may be coated with the conductive coating 95. Alternatively, as depicted in FIGS. 2 and 3, substantially all (e.g., >95%) of the internal and external surfaces 90(*a,b*) may be coated with the conductive coating 95.

For the purpose of this disclosure the terms "about" and "substantially" are used herein with respect to measurable values and ranges due to expected variations known to those skilled in the art (e.g., limitations and variability in measurements).

The conductive coating 95 is applied to the internal and external surfaces 90(*a,b*) of the shroud 50 with a thickness that is in the range of about 15 micrometers to about 100 micrometers. The thickness of the applied coating may be adjusted by the application of one or more layers onto the surface of the shroud 50. Alternatively, the thickness of the applied coating is at least 25 micrometers (0.001 inch) for optimum effectiveness. A coating with a thickness that is less than 25 micrometers tends to be discontinuous, which may affect the desired electrical properties thereof.

The conductive coating 95 is generally cured between a temperature of about 180° C. and about 420° C. The temperature/time associated with the curing may be varied to accommodate the thickness of the coating being cured and/or to alter specific properties exhibited by the coating. Alternatively, the conductive coating 95 is cured at a temperature that is greater than 300° C.

In addition to electrical conductivity, the conductive coating 95 also provides for enhanced chemical and wear resistance, as well as thermal stability at elevated temperatures. The conductive coating 95 may be used in cleaning devices exposed to a maximum in-service temperature of 260° C. These properties allow the cleaning device to be used in conjunction with spray equipment that apply a variety of paint formulations, including without limitation, solventborne primers, waterborne base coats, and solventborne clear coats.

The cleaning fluid may be any organic solvent, water, or combination thereof that is capable of dissolving, solubilizing, or otherwise removing the paint formulation from the atomizer. The cleaning fluid may be dispensed into the cleaning device at ambient temperature (e.g., about 25° C.) or at an elevated temperature in order to enhance the ability of the cleaning fluid to remove the paint formulation from the atomizer. When desirable, the cleaning fluid may also include a gas, such as air, nitrogen, or the like that is continuously or intermittently (e.g., pulsed) dispensed along with the organic solvent(s) and/or water to further enhance the cleaning of the atomizer. In this later case, the cleaning fluid is believed to do more than just wash the surfaces of the atomizer; rather the solvent(s) and/or water are atomized, thereby, delivering a higher energy mixture to the surface of the atomizer.

Figure 4:
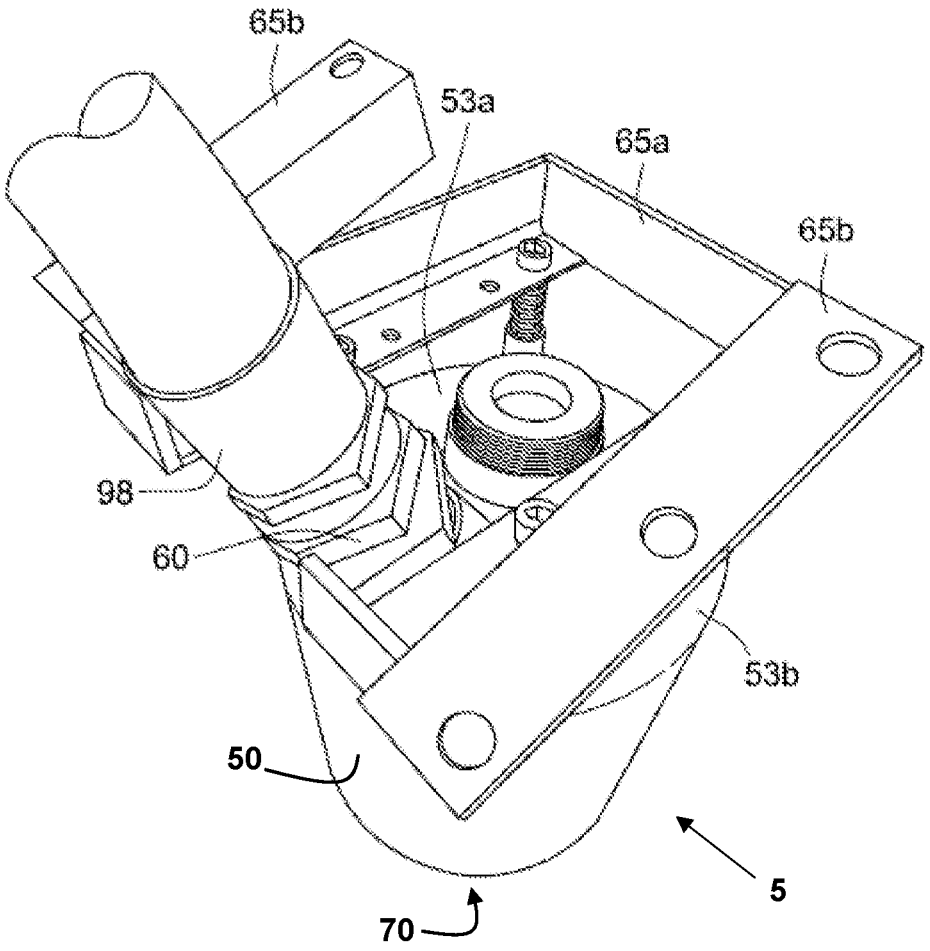
FIG. 4 is a bottom-up view of the cleaning device of FIG. 2.

Referring now to FIG. 4, the exit port 60 is located within the shroud 50 in a location that is opposite to the opening 70 that receives the atomizer. The exit port 60 is not generally located in the center of the bottom 53*a* of the shroud 50, but rather positioned in a location that is near an outer portion or corner of the bottom 53, e.g., close to the sidewall 53*b* of the shroud 50. This exit port 60 comprises an aperture having an inner diameter that is within the range from about 2.54 cm (1 inch) to about 7.62 cm (3 inches). Alternatively, the aperture of the exit port 60 has an inner diameter of about 5.08 cm (2 inches). The exit port 60 may be coupled to a pipe or hose 98 that is connected to a solvent/paint recovery or waste system.

The cleaning device 5 as described above and as further defined herein, meets the specifications set by most industries including without limitation the automotive and aerospace industries, The use of the cleaning device 5 of the present disclosure with its conductive coating enhances the productivity associated with most paint spraying systems. This increased productivity generally results from the enhanced cleaning performance of the device 5 allowing for a reduction in the down time associated having to daily clean and weekly disassemble the device. Typically, the operation of the paint spraying system may be extended to monthly inspection and maintenance intervals.

The size and positioning of the exit port 60 of the cleaning device 5 also improves the draining of the waste cleaning fluid and paint residue, as well reducing the potential for the occurrence of plugging the exit port 60 or the creation of back-spatter onto the atomizer during the cleaning cycle. The cleaning device 5 of the present disclosure may further reduce the manpower support necessary for maintenance by using quick disconnect fittings 115 (shown in FIG. 5) to connect solvent and gas lines to the entrance port 55.

Figure 5:
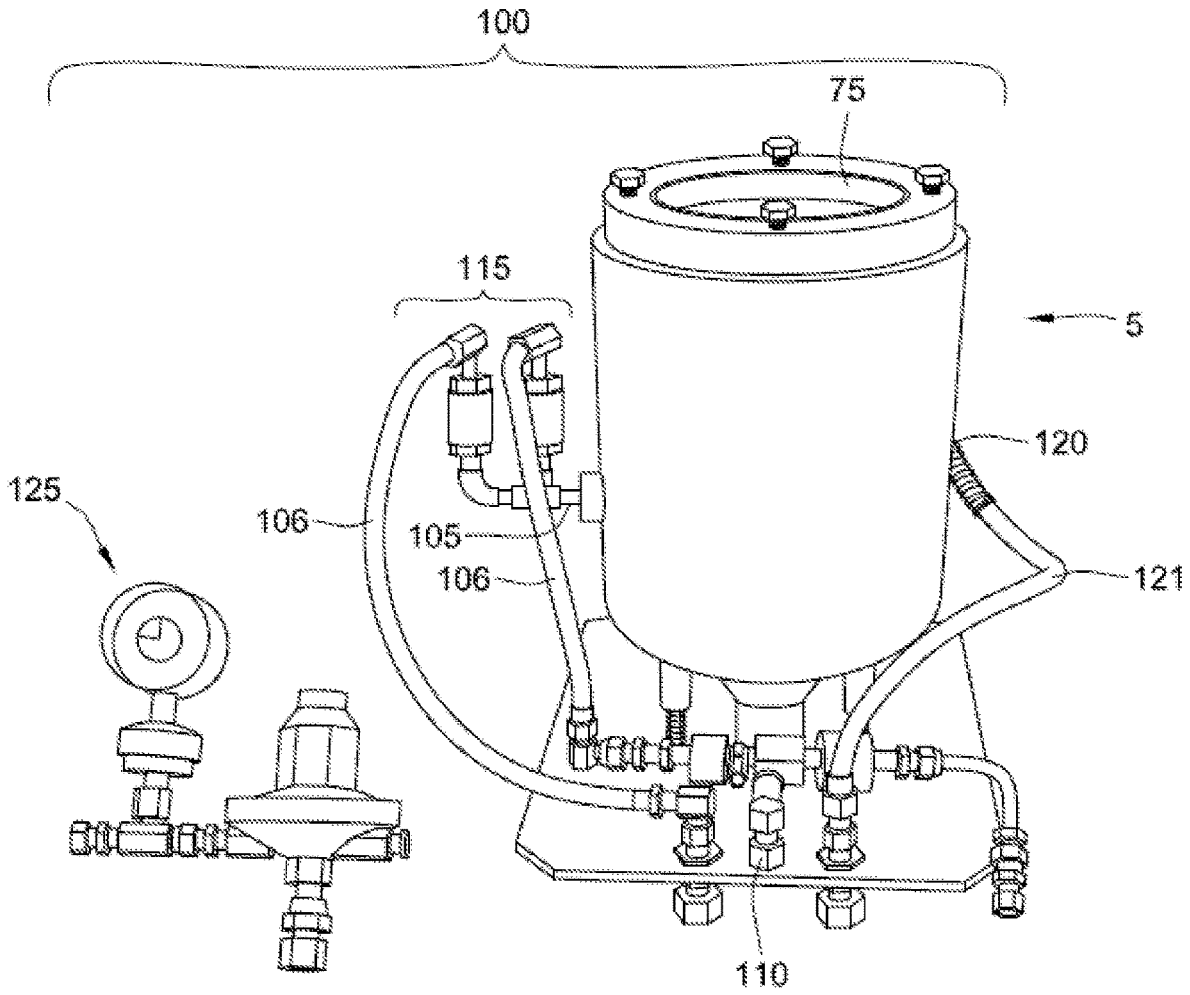
FIG. 5 is a perspective view of a retrofit kit including an assembled cleaning device according to the teachings of the present disclosure.

Referring now to FIG. 5, a kit 100 for retrofitting an existing paint spraying system with the cleaning device of the present disclosure is provided. This kit 100 generally comprises an assembled cleaning device 5 as defined herein. The use of this kit reduces the time and cost associated with replacing an existing conventional cleaning device with a cleaning device that has the various features described herein. In addition, the assembled cleaning device 5 in the kit may also provide a first connection 105 for coupling with a cleaning fluid supply line and a second connection 110 for coupling with a drain funnel or recirculation line used to remove the cleaning fluid after use in the existing paint spraying system. When desirable the retrofit kit 100 may also be used to incorporate a cleaning device 5 during the construction of a new paint spraying system.

The assembled cleaning device 5 may further comprise a third connection 120 that is coupled to a line that supplies a gas, such as air, etc., to the gas-drying ring 75 in order to provide a drying action after completion of the cleaning cycle. When desirable, this third connection 120 may also include a quick disconnect fitting (not shown). Any tubes or lines 106, 121 that are associated with the first 105 or third 120 connections may be comprised of any type of chemical or wear resistant material, including without limitation stainless steel.

Still referring to FIG. 5, when desirable, the retrofit kit 100 may further include a regulator assembly 125 that can be remotely mounted on the outside of the spray booth in which the cleaning device 5 and spray equipment is located. The use of a remotely mounted regulator assembly 125 as further defined herein allows access and adjustment to the operation of the cleaning devices without an operator having to lock-out and enter the spray booth area. The use of this regulator assembly 125 also reduces damage and a need to remove paint build-up from the cleaning device and/or atomizer.

The regulator assembly 125 can effectively control the pressure of the cleaning fluid at about 80 psi in order to enhance the cleaning and drying process. The use of excessive solvent pressure (e.g., >80 psi) during the cleaning cycle may force cleaning fluid and/or paint residue or contaminants into the atomizer shroud, the turbine housing or shaping air rings. The occurrence of cleaning fluid or paint residues into the atomizer components prevent adequate drying, which subsequently may result in drips, craters, and dry flakes/solids becoming inclusions, as well as other paint defects.

Figure 6A:
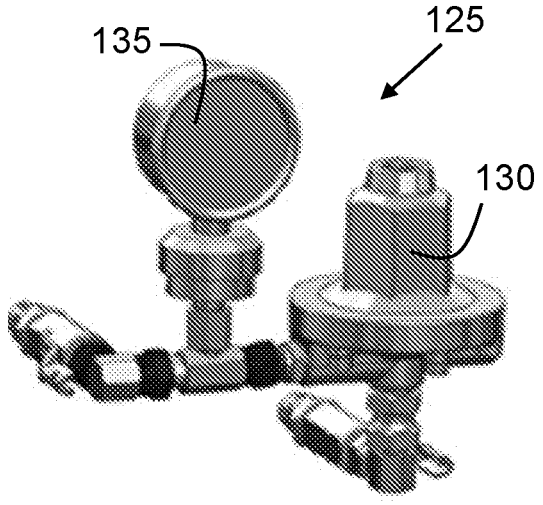
FIG. 6A is a perspective view of a regulator assembly for use in controlling the pressure of the cleaning fluid supplied to the cleaning device of FIG. 2 according to the teachings of the present disclosure.
Figure 6B:
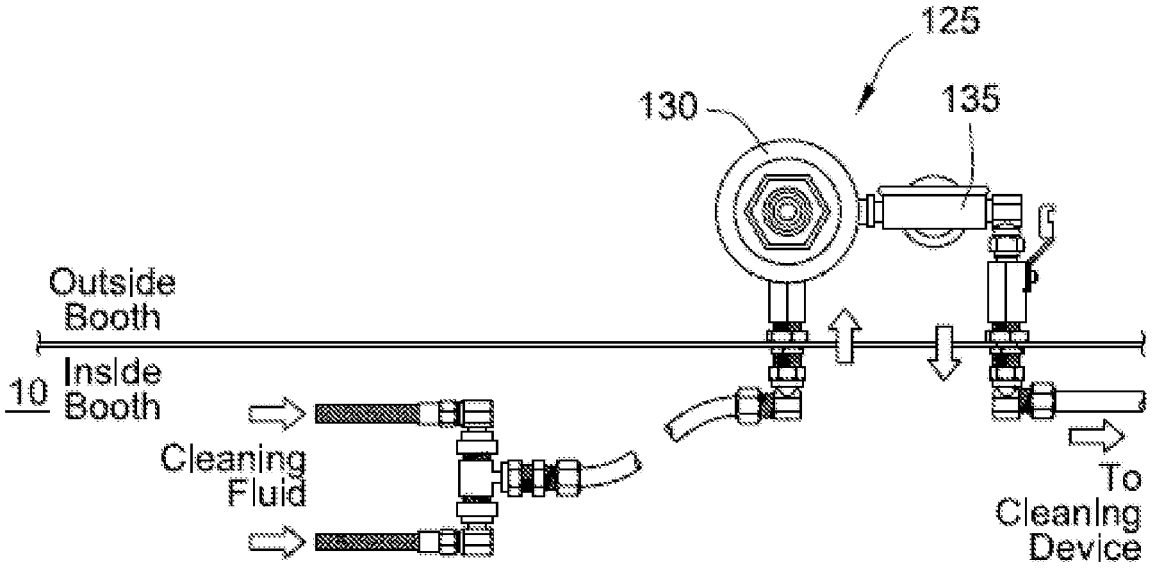
FIG. 6B is a schematic representation of the regulator assembly of FIG. 6A mounted on the external wall of a spray booth.

Referring now to FIGS. 6A and 6B, the regulator assembly 125 is shown in more detail to comprise a variety of fittings along with a regulator 130 and gauge 135. The regulator assembly 125 may be mounted on the outside of a wall of the spray booth with connections from the cleaning fluid supply line and the line coupled to the entrance port of the cleaning device being inside the confines of a spray booth.

Figure 6C:
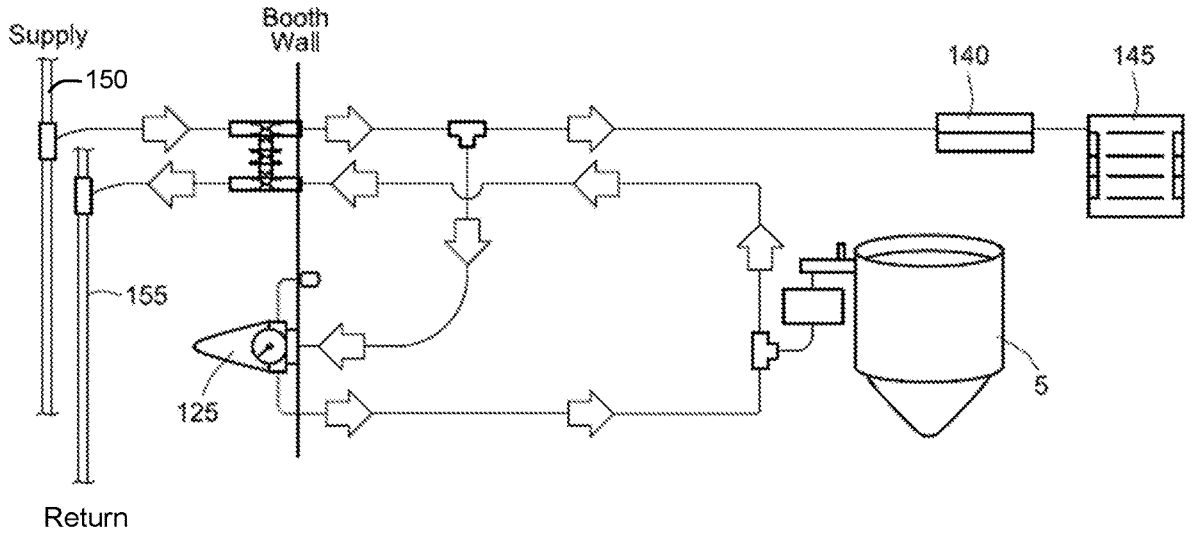
Figure 7:
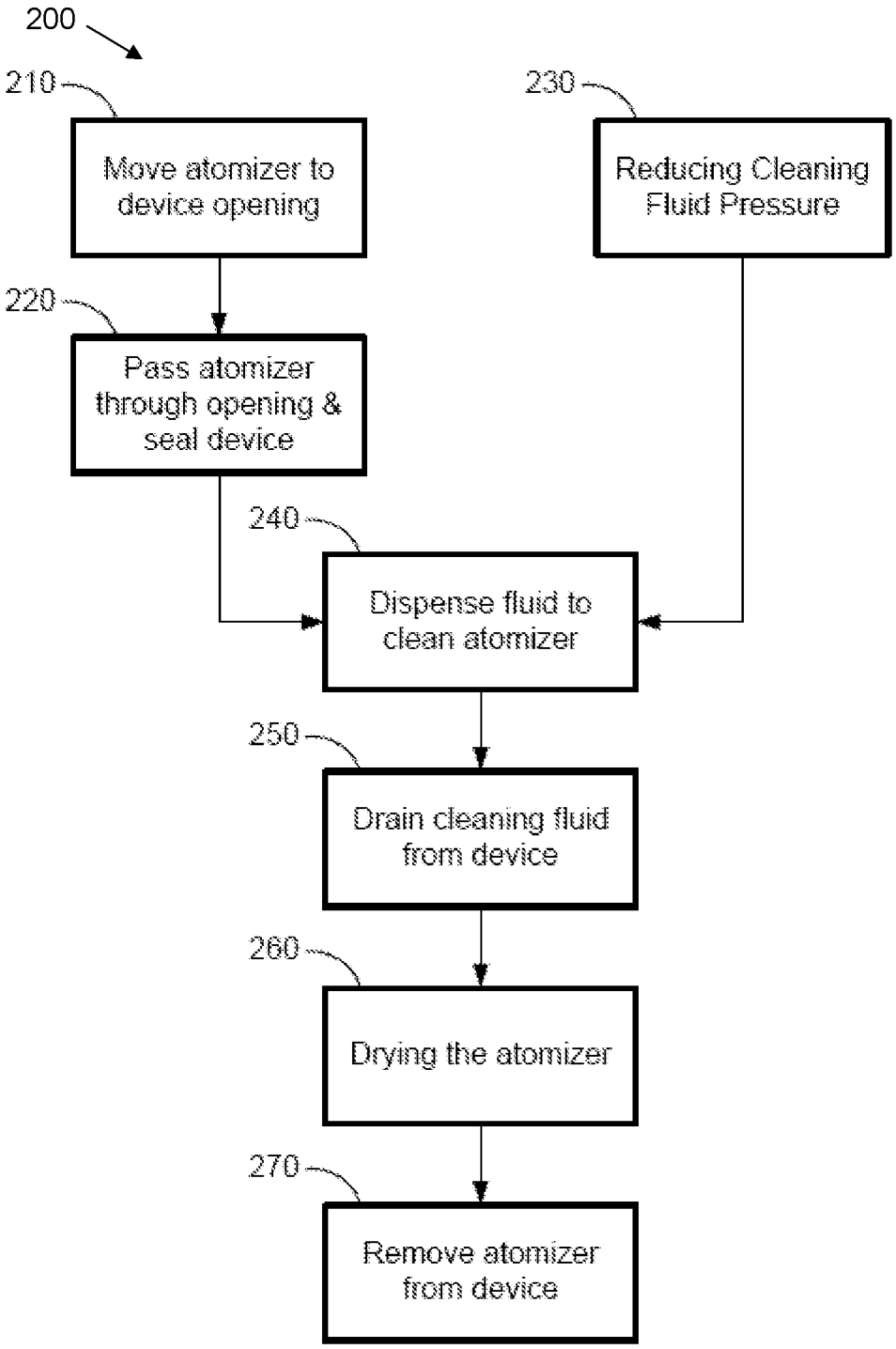
FIG. 7 is a flowchart of a method used to clean an atomizer using the cleaning device of FIG. 2 according to the teachings of the present disclosure.

Referring now to FIG. 6C, the cleaning fluid may be used to purge the heat exchanger 140 and color valves 145 associated with the robotic applicator or atomizer when changing colors during a spray operation. A portion of the cleaning fluid in the robot supply line 150, which is at a high pressure (e.g., >100 psi) and an elevated temperature (e.g., above ambient temperature), can be sent to the regulator assembly 125. The regulator assembly 125 effectively reduces the pressure to about 80 psi prior to allowing the cleaning fluid to continue onto the cleaning device 5 with a portion of the cleaning fluid recirculated back to a return line 155. The use of the regulator assembly 125 allows for the design of a system that reduces the occurrence of any dead-end lines or pipes, thereby, circulating heated cleaning fluid to the point of use.

According to another aspect of the present disclosure, a paint spraying system for applying a paint to a surface of a component is provided. Referring once again to FIGS. 1-4, the paint spraying system 1 generally comprises one or more spraying devices or atomizers 15 configured to deliver the paint to the surface of the component 20 and one or more cleaning devices 5 as previously described above or further defined herein. The paint spraying devices or atomizers 15 are located within a paint spray booth 10. When desirable, the paint spraying system may further comprise one or more robotic arms 25 capable of reversibly moving the atomizer from the surface of the component 20 to the opening 70 in the shroud 50 of the cleaning device 5.

Referring once again to FIGS. 6A-6C, the paint spraying system may also comprise a regulator assembly 125 mounted on the wall of the spray booth 10, such that the regulator is located outside or external to the booth. The connection to the regulator assembly 125 arising from the cleaning fluid supply line and the connection from the regulator assembly 125 to the line coupled to the entrance port of the cleaning device may be located inside the confines of a spray booth.

According to yet another aspect of the present disclosure, a method of cleaning an atomizer used in a paint spraying system to apply a paint to a surface of a component in a spray booth is provided. This method 200 generally comprises moving the atomizer 210 after applying the paint to the surface of the component to the opening in the cleaning device as described above and further defined herein; delivering the cleaning fluid 220 to the cleaning device; allowing the cleaning fluid to be dispensed 230 through the aperture of the cleaning nozzle so that the cleaning fluid makes contact with the atomizer in order to clean the atomizer; draining the cleaning fluid 240 that collects with the shroud through the exit port; drying the atomizer 250; and removing the cleaned atomizer 260 from the cleaning device. When desirable, the method may further comprise using a regulator assembly 270 to reduce the pressure exhibited by the cleaning fluid to about 80 psi with the regulator assembly being located external to the spray booth.

The following specific examples are given to illustrate the performance of the cleaning device formed according to the teachings of the present disclosure and should not be construed to limit the scope of the disclosure. Those skilled-in-the-art, in light of the present disclosure, will appreciate that many changes can be made in the specific embodiments which are disclosed herein and still obtain alike or similar result without departing from or exceeding the spirit or scope of the disclosure. One skilled in the art will further understand that any properties reported herein represent properties that are routinely measured and can be obtained by multiple different methods. The methods described herein represent one such method and other methods may be utilized without exceeding the scope of the present disclosure.

EXAMPLE 1

Cleaning Device Performance

Figure 8:
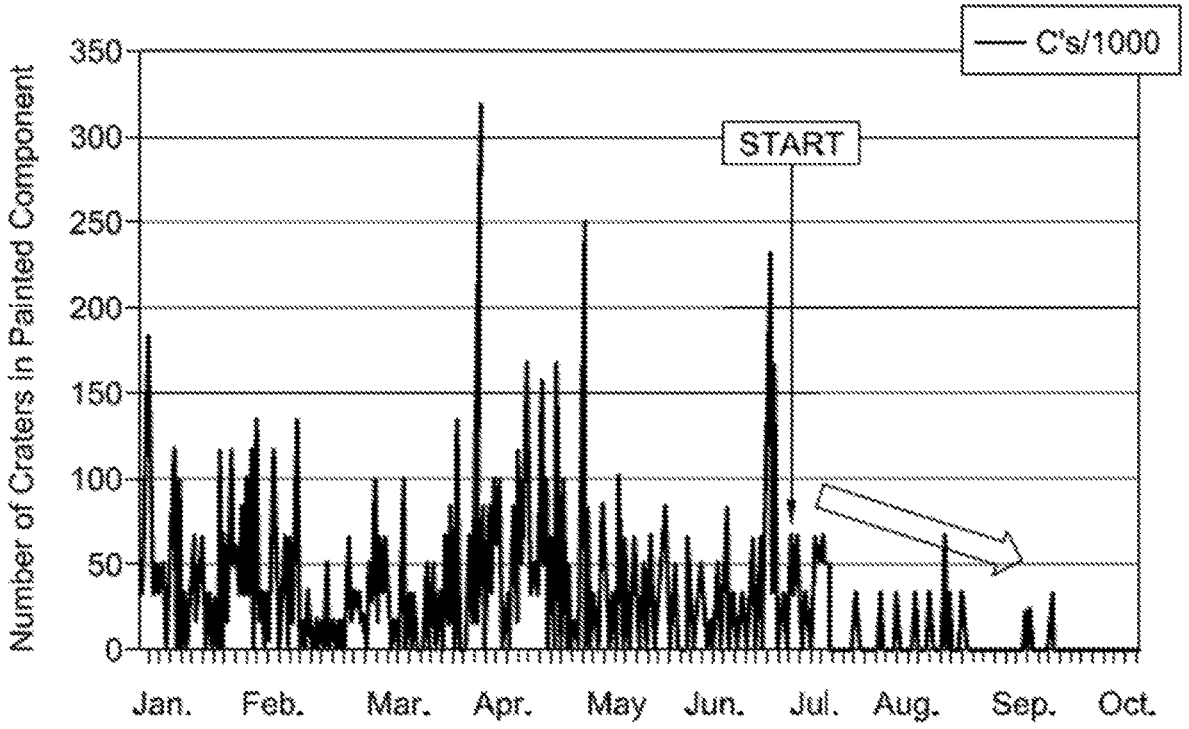
FIG. 8 is a graphical representation of the number of defects observed in painted parts plotted as a function of time.

The number of craters caused by drips and the cleaning cycle for cleaning automated application in a manufacturing line applying a solventborne primer to a component was monitored for multiple months (January through June) as shown in FIG. 8. The spray painting system was upgraded in July with the cleaning devices of the present disclosure with a conductive coating and an enlarged and repositioned exit port being installed. A substantial decrease in the number of craters caused by the cleaning cycle was observed from July through September after installation as shown in FIG. 8. Each data point shown in FIG. 8 represents the number of craters (C's) measured in the paint applied to 1,000 components.

This example demonstrates that the cleaning device defined within the present disclosure effectively reduces the number of defects in painted components that are caused by the cleaning cycle. Overall, the ability of the cleaning devices of the present disclosure to remove residual paint from spray devices or atomizers represents a substantial improvement over the cleaning ability of conventional cleaning devices.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A paint spraying system for applying a paint to a surface of a component, the system comprising:

one or more spraying devices having an atomizer configured to deliver the paint to the surface of the component, the one or more spraying devices located within a spray booth; and one or more cleaning devices, the cleaning device comprising:

a plurality of cleaning nozzles having an aperture through which a cleaning fluid is dispensed;

a movable member upon which at least one of the cleaning nozzles is located; a shroud having an internal and external surface; the shroud encompassing the movable member, such that the dispensed cleaning fluid is contained therein, the shroud comprising:

an entrance port capable of being opened or closed, such that the cleaning fluid is allowed to flow there through when the entrance port is opened in order for the cleaning fluid to be dispensed from the cleaning nozzles;

an exit port capable of being opened or closed, such that the dispensed cleaning fluid that collects within the shroud can be removed when the exit port is opened; and an opening capable of receiving the atomizer; wherein upon receiving the atomizer, the opening is sealed such that the dispensed cleaning fluid is contained within the shroud; and a gas-drying ring that surrounds at least a portion of the opening; wherein at least a portion of the internal surface, the external surface, or a combination thereof is coated with a conductive coating, wherein at least one of the cleaning nozzles is configured dispense cleaning fluid to wet the internal surface, wherein the conductive coating is static dissipative having a surface resistance that is greater than $1\times10^{1}$ ohms/square and less than $1\times10^{12}$ ohms/square.

2. The paint spraying system of claim 1, wherein the system further comprises one or more robotic arms capable of reversibly moving the atomizer from the surface of the component to the opening in the shroud.

3. The paint spraying system of claim 1, wherein the conductive coating comprises one or more fluoropolymers.

4. The paint spraying system of claim 1, wherein the conductive coating is applied to at least 75% of the internal surface or external surface of the shroud.

5. The paint spraying system of claim 1, wherein the conductive coating is further applied to one or more of the movable member, the exit port, and the entrance port.

6. The paint spraying system of claim 1, wherein the exit port is located within the shroud in a location that is opposite to the opening that receives the atomizer and near a bottom corner of the shroud.

7. The paint spraying system of claim 1, wherein the exit port comprises an aperture having an inner diameter within the range from about 2.54 cm to about 7.62 cm.

8. A cleaning device for an atomizer, the cleaning device comprising:

a plurality of cleaning nozzles having an aperture through which a cleaning fluid is dispensed;

a movable member upon which at least one of the cleaning nozzles is located;

a shroud having an internal and external surface; the shroud encompassing the movable member, such that the dispensed cleaning fluid is contained therein, the shroud comprising: an entrance port capable of being opened or closed, such that the cleaning fluid is allowed to flow there through when the entrance port is opened in order for the cleaning fluid to be dispensed from the cleaning nozzles;

an exit port capable of being opened or closed, such that the dispensed cleaning fluid that collects within the shroud can be removed when the exit port is opened; and an opening capable of receiving the atomizer; wherein upon receiving the atomizer, the opening is sealed such that the dispensed cleaning fluid is contained within the shroud; and a gas-drying ring that surrounds at least a portion of the opening; wherein at least a portion of the internal surface, the external surface, or a combination thereof is coated with a conductive coating, wherein at least one of the cleaning nozzles is configured dispense cleaning fluid to wet the internal surface, wherein the conductive coating is static dissipative having a surface resistance that is greater than $1\times10^{1}$ ohms/square and less than $1\times10^{12}$ ohms/square.

9. The cleaning device of claim 8, wherein the conductive coating is applied to at least 75% of the internal surface or external surface of the shroud.

10. The cleaning device of claim 8, wherein the conductive coating is further applied to one or more of the movable member, the exit port, and the entrance port.

11. The cleaning device of claim 8, wherein the exit port is located within the shroud in a location that is opposite to the opening that receives the atomizer and near a bottom corner of the shroud.

12. The cleaning device of claim 8, wherein the conductive coating comprises one or more fluoropolymers.

13. The cleaning device of claim 12, wherein the one or more fluoropolymers includes polytetrafluoroethylene (PTFE), fluorinated ethylyene-propylene (FEP), perfluoroalkoxy polymers (PFA), or a mixture or copolymer thereof.

14. The cleaning device of claim 8, wherein the exit port comprises an aperture having an inner diameter within the range from about 2.54 cm to about 7.62 cm.

15. The cleaning device of claim 14, wherein the exit port comprises an aperture that has an inner diameter of about 5.08 cm.

16. The cleaning device of claim 8, wherein the cleaning device further comprises a first connection for coupling with a cleaning fluid supply line, a second connection for coupling to a drain funnel or recirculation line used to remove the cleaning fluid from the cleaning device; and a third connection for coupling with a line that supplies a gas to the gas-drying ring.

17. The cleaning device of claim 16, wherein one or more of the first or third connections comprise a quick-disconnect fitting.

* * * * *